United States Patent [19]

Bennett

[11] Patent Number: 4,787,822

[45] Date of Patent: Nov. 29, 1988

[54] VOLUME CONTROL FOR MULTI-NOZZLE ROTARY PUMP FILLING SYSTEMS

[75] Inventor: Richard N. Bennett, Arbutus, Md.

[73] Assignee: National Instrument Company, Inc., Baltimore, Md.

[21] Appl. No.: 850,017

[22] Filed: Apr. 10, 1986

[51] Int. Cl.[4] ..... F04B 49/02; F04B 49/08; F04B 17/00; B05B 9/00

[52] U.S. Cl. ..... 417/2; 417/42; 417/286; 417/427; 239/124

[58] Field of Search ..... 417/426.6, 428.2, 440, 417/441, 286, 42; 239/124; 251/122, 903; 137/567, 866; 222/318, 135; 141/234, 236, 83

[56] References Cited

U.S. PATENT DOCUMENTS

| | | | |
|---|---|---|---|
| 2,757,839 | 8/1956 | Carew | 222/330 |
| 3,081,909 | 3/1963 | Hooker | 222/135 |
| 3,147,767 | 9/1964 | Goss | 22/318 |
| 3,381,855 | 5/1968 | Wells | 222/318 |
| 3,628,727 | 12/1971 | Gjerde | 239/124 |
| 3,819,303 | 6/1974 | Pfleger | 417/440 |
| 3,847,507 | 11/1974 | Sakiyama | 417/42 |
| 3,910,462 | 10/1975 | Abeles | 222/135 |
| 4,106,699 | 8/1978 | Holt | 239/124 |
| 4,175,587 | 11/1979 | Chadwick | 230/124 |
| 4,186,877 | 2/1986 | Wilcox | 239/124 |
| 4,292,747 | 10/1981 | Hoppe | 417/426 |
| 4,387,851 | 6/1983 | Dick | 239/124 |
| 4,435,134 | 3/1984 | Okada | 417/440 |

*Primary Examiner*—William L. Freeh

*Attorney, Agent, or Firm*—Paul M. Craig, Jr.

[57] ABSTRACT

A volume control for a multi-nozzle rotary pump filling system in which a plurality of rotary pumps are driven from a common drive. Each pump is connected with its own nozzle by way of a connection that includes a volume control operable to adjust the back pressure on the rotary pump to thereby vary the amount of product dispensed by the nozzle. In case of more viscous products, a by-pass line which includes a relief valve is also provided between the inlet side of the control unit and the in-feed side of the pump.

18 Claims, 3 Drawing Sheets

VOLUME CONTROL FOR MULTI-NOZZLE ROTARY PUMP FILLING SYSTEMS

The present invention relates to a volume control for a multi-nozzle rotary pump filling system.

Two types of multi-nozzle rotary pump filling systems are known in the prior art. In one type of such system, each rotary pump is driven by a separate motor and is equipped with an individual count monitoring system. In the other type of such system, a single motor is provided driving several pumps. However, since the amount of the product dispensed by an interconnected pump-nozzle combination varies, even though the pump, tubing and nozzle are of the same design, it becomes necessary to provide a count-monitoring system and a clutch-brake system for each pump to obtain the desired fill volumes.

It is the principal object of the present invention to provide a multi-nozzle rotary pump filling system which permits a certain amount of volume adjustment in connection with a precision rotary pump, such as a vane pump or gear pump without changing the rotational speed of the drive system, the number of counts on the monitoring system or disengaging a clutch.

Another object of the present invention resides in a volume control for a multi-nozzle rotary pump filling system which is relatively simple in construction, low in cost, easy to manipulate and accurate in determining the amount of product dispensed by a given interconnected pump nozzle combination.

The underlying problems are solved according to the present invention by an adjustable fill volume control which is operable to adjust the pressure between the pump and the nozzle connected therewith and which includes some means, for example, in the form of a pressure gauge to indicate the amount of back pressure and therewith the amount of product dispensed for the given back pressure.

Rotary pumps are available in various types, such as gear pumps, vane pumps, etc. The flow rate thorugh a vane pump is directly affected by the pressure between the discharge side of the pump and the nozzle. By increasing or decreasing the pressure betweeen the discharge side of the pump and the nozzle, the flow rate will either be decreased or increased. This is true for a wide viscosity range of the product to be filled. Thus, to control the amount of product dispensed by a given interconnected pump-nozzle combination, with the assumption that the rotary speed of the driving motor and the number of counts (total number of revolutions made by the pump) stays the same, it is simply necessary to change the pressure between the pump and the nozzle. The amount of product dispensed can be readily calibrated either at the factory or by the user.

An apparatus for proportionally blending liquids is known in the prior art (U.S. Pat. No. 2,564,306 to Isreeli et al.) in which pressure-balancing valves are connected to the inputs of a number of metering gear sets. However, the purpose of the balancing valves in this prior art apparatus is to eliminate the pressure drop across the respective pairs of metering gears. As all the gears rotate at the same speed, the total rate of flow through any one or all of the gears is determined by the rate of rotation. The rate at which the combined liquid is supplied is therefore varied by varying the rate at which the liquid is supplied through the pipe driving the motor gears. There is no volume control in the output of each pair of metering gears to adjust the amount of liquid supplied thereby in order to assure that identical quantities of liquids are supplied by each pair of metering gears.

In another prior art fluid-distributing apparatus (U.S. Pat. No. 2,706,520 to Chandler), the delivery of equal quantities of fuel to the nozzles of the turbine is assured by a complex system utilizing a pilot line controlling the diaphragms of the valves in the discharge nozzles. Each diaphragm thereby operates a valve to maintain a correspondingly constant pressure on the downstream side of a metering restriction so that the same pressure drop exists across the three metering restrictions. Further, the pressure drop across each metering restriction is the same only if their areas are the same and the flow through each of them is the same. Additionally, only a single pump is used which supplies fuel to all of the discharge nozzles. Thus, there is no individually adjustable volume control for each nozzle to assure that the amount of product dispensed is identical.

The principal advantages attainable with the present invention reside in the ease of individual adjustment in each interconnected rotary pump-nozzle combination of a multi-nozzle rotary pump filling system which permits easy and accurate adjustment of the fill volume in each such combination to maintain the same constant.

These and other objects, features and advantages of the present invention will become more apparent from the following description when taken in connection with the accompanying drawing which shows, for purposes of illustration only, two embodiments in accordance with the present invention, and wherein.

Figure 1:
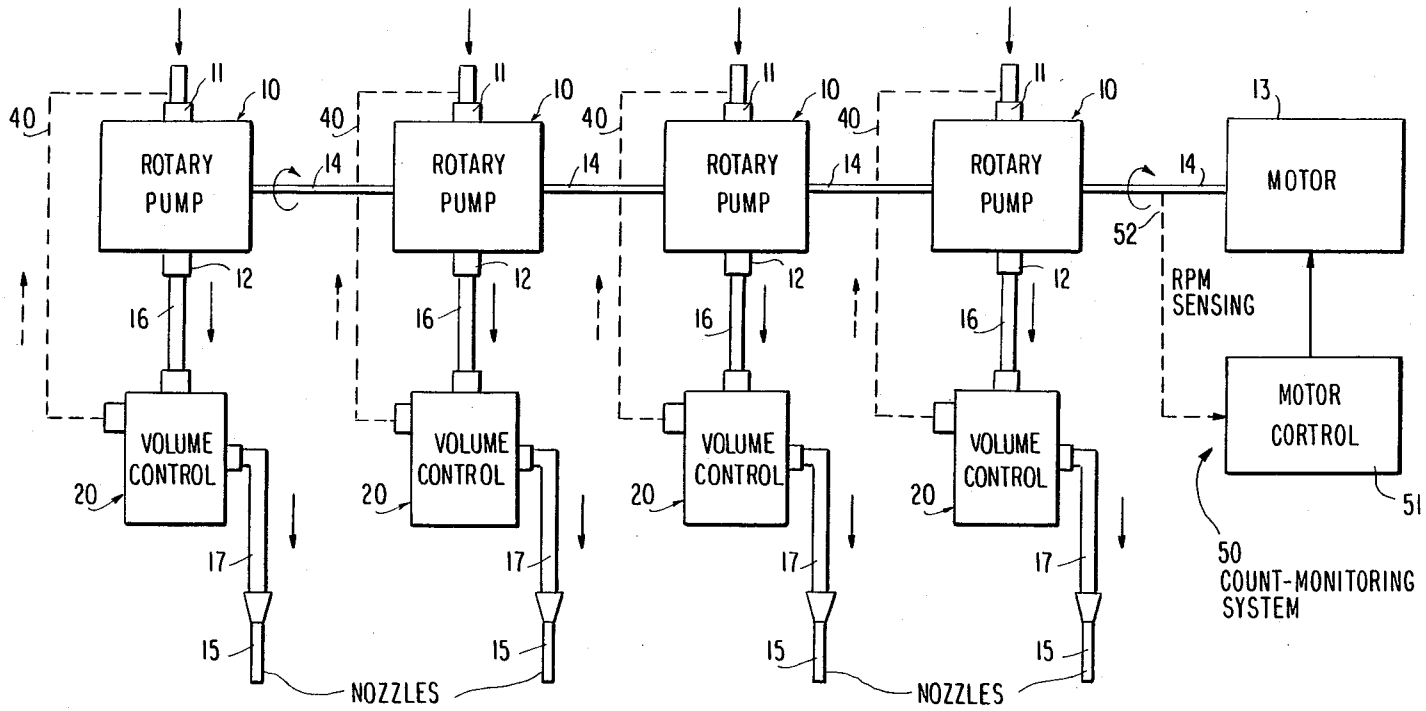
FIG. 1 is a schematic diagram of a multi-nozzle rotary pump filling system in accordance with the present invention.

Referring now to the drawing wherein like reference numerals are used throughout the various views to designate like parts, a multi-nozzle rotary pump filling system is schematically illustrated in FIG. 1, which includes a plurality of rotary pumps generally designated by reference numeral 10. Each rotary pump includes an in-feed side 11 and a discharge side 12. All of the rotary pumps 10 are driven from a single motor 13, for example, an electric motor, by way of a common drive 14. The multi-nozzle rotary pump filling system includes also a number of filling nozzles 15 corresponding to the number of rotary pumps. Each rotary pump 10 is connected with the corresponding nozzle 15 by way of a line section 16 connecting the discharge side 12 of a given rotary pump with the inlet connection 23 (FIGS. 2 and 3) of a volume control providing an adjustable restricted passage generally designated by reference numeral 20 and of a line section 17 (FIG. 1) connecting the outlet connection 24 (FIGS. 2 and 3) with the corresponding nozzle 15.

FIG. 1 also indicates in dash line a by-pass connection 40 which may be provided as will be more fully described hereinafter. While four rotary pumps 10 are shown in the drawing, it is understood that this is only for purposes of illustration and that the number may be varied at will.

Figure 2:
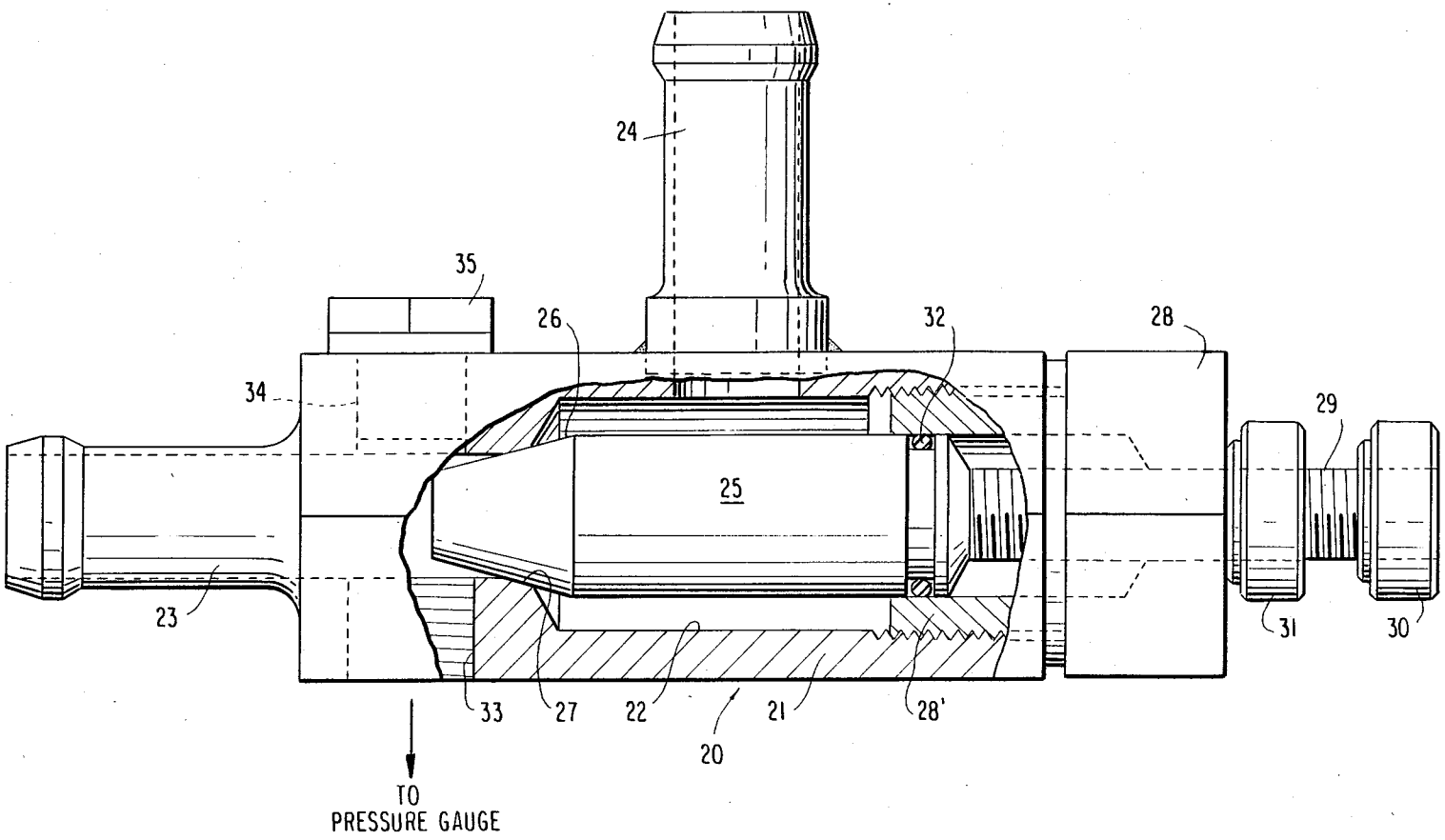
FIG. 2 is an elevational view, partly broken away, of a pressure/volume regulator unit in accordance with the present invention.
Figure 3:
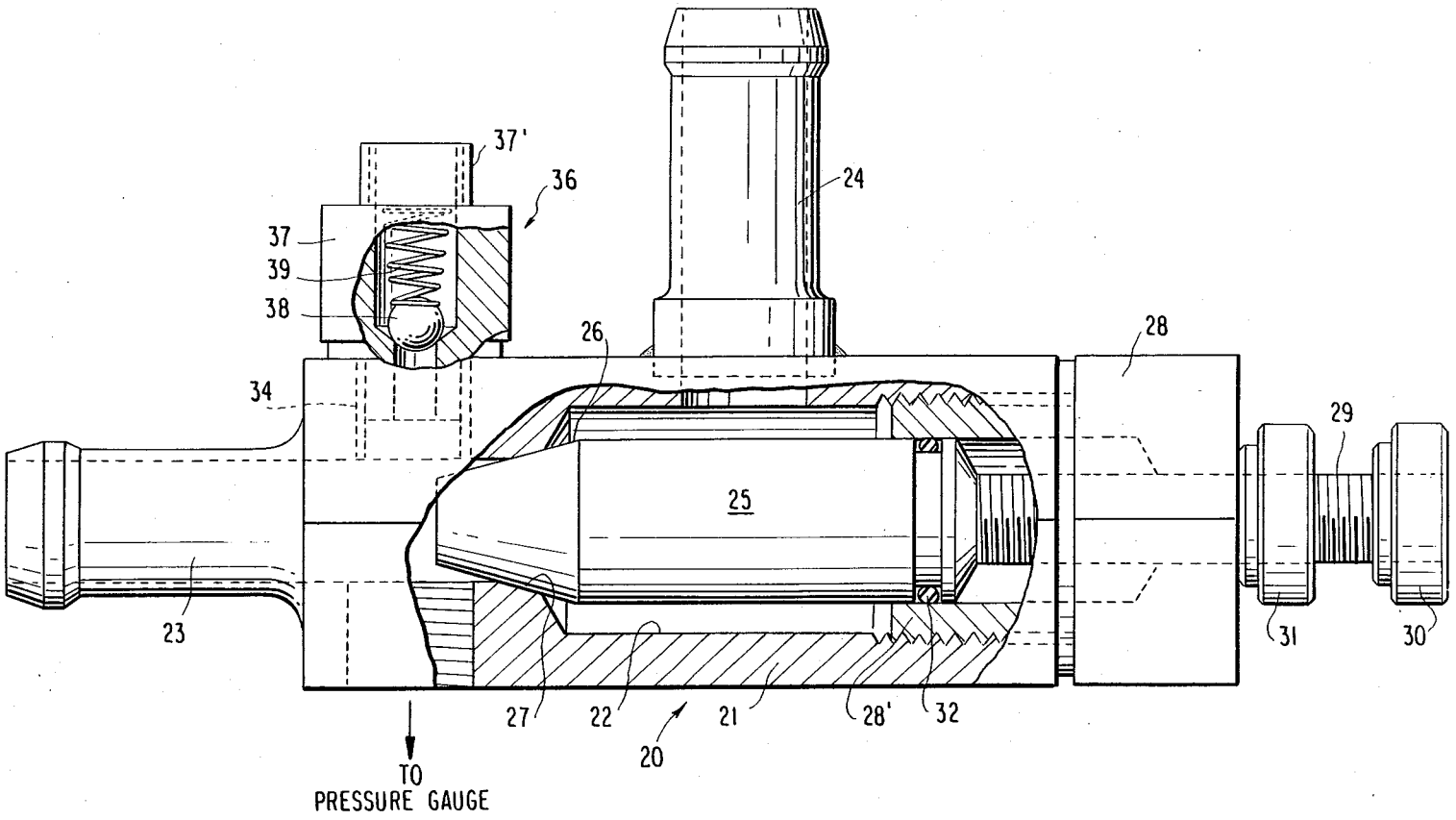
FIG. 3 is an elevational view, partly broken away, similar to FIG. 2, of a pressure/volume regulator unit for use with a by-pass system.

Referring now to FIG. 2, each volume control unit 20 includes a housing 21 provided with a valve chamber 22, an inlet connection 23 and an outlet connection 24. The outlet connection 24 is in free communication with the valve chamber 22. A needle-like valve member 25 is axially adjustable within the valve chamber 22. The tapered valve portion 26 of the valve member 25 is adapted to cooperate with a valve seat 27 formed in the housing 21. The valve seat 27 has a flat valve seating surface which is substantially complementary to the tapered surface of the valve portion 26. The end of the housing 21 opposite the inlet connection is closed off by a cap 28 having a threaded sleeve 28' integral therewith which is adapted to engage with the internal threads provided in the housing 21. The valve member 25 is provided with a threaded shank 29 at its end opposite the valve portion 26. The threaded shank 29 is thereby adapted to be screwed in and out of the internal threaded portion of the cap 28 by means of rotation of an actuating knob 30 suitably secured to the end of the shank 29. To fix the valve member 25 in a predetermined axial position, a lock knob 31 is also provided on the threaded shank 29. An O-ring in a circumferential groove provided in the valve member 25 seals the valve member 25 with respect to the sleeve-like extension 28' of the cap 20 and therewith effectively seals the right end of the housing 21 as viewed in FIGS. 2 and 3.

A threaded port 33 which is in free communication with the inlet connection 23 is provided in the left end of the housing 21. The threaded port 33 which extends at right angle to the axial direction of the housing 21 and of the valve member 25 serves for connection with a pressure gauge for purposes to be described hereinafter. A threaded by-pass port 34 which is disposed opposite the threaded pressure gauge port 33 is closed off by a threaded plug 35 when no by-pass line is used.

OPERATION

The rotary pumps 10 of the multi-nozzle rotary pump filling system of FIG. 1 all rotate at the same rpm and all carry out the same number of counts, i.e., total number of revolutions made by the pump for a given filling operation as is monitored by a count-monitoring system generally designated by reference numeral 50 and of any conventional construction forming no part of the present invention. For example, this system 50 may include a count (rpm) sensor 52 connected with monitor control 51 which in turn controls the energization and stoppage of motor 13 in a conventional manner. As such count-monitoring systems 50 are known in the art and are commercially available, a detailed description thereof is dispensed with herein. If, due to variations in the pump, tubing or nozzle, it become necessary to adjust the amount of product dispensed by a given interconnected pump-nozzle combination, it is only necessary to rotate the knob 30 until a reading is obtained on the pressure gauge connected to the threaded port 33 which corresponds, by precalibration, to the predetermined amount of product to be filled. As is quite apparent, each pump-nozzle combination can be adjusted individually in a very simple and highly accurate manner to assure that identical amounts of product are dispensed by each pump-nozzle combination by adjusting the restricted passage in the volume control 20. Each pump-nozzle combination can thereby be precalibrated at the factory with the calibration chart supplied to the customer. In the alternative, such calibration can also be easily carried out at the customer.

Additionally, in lieu of a pressure gauge, any other kind of indicating means may be used for purposes of set-up procedure. All that is necessary for the fill volume to be able to be adjusted either up or down, is to adjust the actuating knob 30 so that the pressure can be increased or decreased from the start-up reference pressure.

When dispensing a free-flowing product, such as water, through a gear pump, the volume control in accordance with the present invention will enable the fill volumes to be adjusted either up or down. However, as the product which is dispensed through the nozzles becomes more viscous, increasing the back pressure has less effect on the product flow rate through the gear pump. This is because there is less slippage of the product in the gear housing as the product becomes more viscous. To compensate for this problem, the present invention provides a spring-loaded by-pass system which is schematically indicated in FIG. 1 by the dash line 40. This by-pass system includes a relief valve assembly generally designated by reference numeral 36 (FIG. 3) which is screwed into the threaded port 34 after the plug member 35 (FIG. 2) has been unscrewed. The relief valve assembly 36 includes a valve housing 37 with an outlet connection 37', a valve ball 38 and a valve spring 39. The by-pass line 40 connects the outlet connection 37' with the in-feed side 11 of the corresponding rotary pump. In the alternative, the by-pass line 40 may also connect the outlet connection 37' with the reservoir tank. In operation, as the back pressure is increased, the relief valve 36 will open, thereby allowing a portion of the product flow to be diverted back to the in-feed side 11 of the rotary pump 10, instead of being fed through the corresponding nozzle 15. As a result thereof, the amount of product dispensed by the corresponding nozzle 15 is reduced.

The volume control in accordance with the present invention also inherently provides an additional advantage. By increasing the back pressure on the rotary pump 10 by appropriate adjustment of the valve member 25, in excess of the pressure provided by the by-pass system, the device may be cleaned in place. In other words, a cleaning liquid is fed through the rotary pump 10 into the volume control unit 20 and if the back pressure is so adjusted that the relief valve 36 will open, the rotary pump 10 will be flushed out and will thereby be cleaned without having to disconnect any part of the system while only a smaller portion of the cleaning liquid will flow through the corresponding nozzle.

While I have shown and described only two embodiments in accordance with the present invention, it is understood that the same is not limited thereto, but is susceptible of numerous changes and modifications as known to those skilled in the art, and I therefore do not wish to be limited to the details shown and described herein, but intend to cover all such changes and modifications as are encompassed by the scope of the appended claims.

I claim:

1. A volume control for multi-nozzle rotary pump filling systems in which several containers are to be filled simultaneously with the same amount of fluid product, comprising a plurality of rotary pump means, each having an in-feed side and a discharge side, a plurality of nozzle means, common drive means for said rotary pump means including monitoring means for monitoring at least the number of revolutions made by the pump means and operable to control the common drive means in such a manner that said pump means deliver the fluid product to said nozzle means at the same time, and connecting means operatively connecting a respective pump means with a corresponding nozzle means to provide a multi-nozzle filling system, said connecting means including, in each operative connection between a respective pump means and the corresponding nozzle means of the multi-nozzle filling system control means in each such operative connection for individually controlling the amount of product dispensed by a corresponding nozzle means by adjustably varying the back pressure on the respective pump means operatively connected therewith, and said control means including adjustable restricted passage means in the connection means between a respective pump means and the corresponding nozzle means to enable fine adjustment of the amount of fluid product delivered by a given nozzle means.

2. A volume control according to claim 1, wherein said control means enables individual adjustment of each pump-control-nozzle interconnection of said multi-nozzle rotary pump filling system to a precalibrated setting for a predetermined amount of product dispensed by its nozzle means.

3. A volume control according to claim 1, wherein said monitoring means also monitors the rotary speed of said common drive means.

4. A volume control according to claim 1, wherein the control means includes a housing means having an inlet connection and an outlet connection, said outlet connection being in communication inside of said housing means with said inlet connection and operatively connected with a respective nozzle means, and adjustable valve means in said communication to adjustably vary the back pressure on the corresponding pump means operatively connected with the inlet connection.

5. A volume control according to claim 4, wherein said communication includes a valve chamber means in substantially free communication with the outlet connection, said adjustable valve means including a valve member having a valving portion tapering in its axial direction for adjustable engagement with a valve seat formed inside said housing means between said valve chamber means and said inlet connection, and adjusting means for finely adjusting the axial position of said valve member relative to said valve seat to vary the throttling effect and therewith the back pressure.

6. A volume control according to claim 5, wherein said adjusting means includes a threaded shank rotating in unison with said valve member and engaging with a complementary threaded bore in said housing means, an actuating knob on the portion of said threaded shank extending outside said housing means, and a locking knob on said threaded shank intermediate said actuating knob and said housing means for locking the valve member in a given axial position.

7. A volume control according to claim 6, wherein said valve seat includes a tapered surface portion complementary to the tapered valving portion of said valve member.

8. A volume control according to claim 7, further comprising means enabling calibration of the control means to thereby enable simple and accurate adjustment for a predetermined amount of product dispensed by a respective interconnected pump-control-nozzle combination.

9. A volume control according to claim 8, wherein said means enabling calibration includes a pressure gauge operatively connected to the inlet connection.

10. A volume control according to claim 9, further comprising feedback means operatively connecting the inlet connection with the in-feed side of the respective pump means including relief valve means.

11. A volume control according to claim 10, wherein said relief valve means includes a relief-valve assembly adapted to be threadably connected to a threaded port in said housing means, said threaded port being in communication with the inlet connection.

12. A volume control according to claim 11, wherein said port is adapted to be closed off by a threaded plug member when said feedback means is unnecessary.

13. A volume control according to claim 1, further comprising means enabling calibration of the control means to thereby enable simple and accurate adjustment for a predetermined amount of product dispensed by a respective interconnected pump-control-nozzle combination.

14. A volume control according to claim 13, wherein said means enabling calibration includes a pressure gauge operatively connected to the inlet connection.

15. A volume control according to claim 1, further comprising feedback means operatively connecting the inlet connection with the in-feed side of the respective pump means including relief valve means.

16. A volume control according to claim 15, wherein the rotary pump means are gear pumps.

17. A volume control according to claim 15, wherein said relief valve means includes a relief-valve assembly adapted to be threadably connected to a threaded port in said housing means, said threaded port being in communication with the inlet connection.

18. A volume control according to claim 17, wherein said port is adapted to be closed off by a threaded plug member when said feedback means is unnecessary.

* * * * *